US011193487B2

(12) United States Patent
Gutberlet et al.

(10) Patent No.: US 11,193,487 B2
(45) Date of Patent: Dec. 7, 2021

(54) SPIRAL COMPRESSOR WITH OIL RECIRCULATION UNIT

(71) Applicant: Hanon Systems, Daejeon (KR)

(72) Inventors: Dirk Gutberlet, Würselen (DE); Kadir Dursun, Hürth (DE); Michael Friedl, Pulheim (DE)

(73) Assignee: HANON SYSTEMS, Daejeon (KR)

( * ) Notice: Subject to any disclaimer, the term of this patent is extended or adjusted under 35 U.S.C. 154(b) by 252 days.

(21) Appl. No.: 16/542,508

(22) Filed: Aug. 16, 2019

(65) Prior Publication Data

US 2020/0072219 A1 Mar. 5, 2020

(30) Foreign Application Priority Data

Aug. 30, 2018 (DE) ..... 102018121185.6
Jan. 25, 2019 (DE) ..... 102019101855.2

(51) Int. Cl.
*F04C 29/00* (2006.01)
*F04C 29/02* (2006.01)
*F04C 18/02* (2006.01)
*F04C 23/00* (2006.01)

(52) U.S. Cl.
CPC ..... *F04C 18/0215* (2013.01); *F04C 18/0246* (2013.01); *F04C 29/026* (2013.01); *F04C 29/028* (2013.01); *F04C 2210/26* (2013.01)

(58) Field of Classification Search
CPC ..... F04C 18/0215; F04C 18/0246; F04C 18/0253; F04C 29/026; F04C 29/028; F04C 23/008; F04C 29/0035
See application file for complete search history.

(56) References Cited

U.S. PATENT DOCUMENTS 2,753,696 A * 7/1956 Guerra ..... B60H 1/3226 62/163
2006/0171832 A1* 8/2006 Oiwake ..... F04C 29/026 418/55.6
2015/0361981 A1* 12/2015 Kawano ..... F04C 29/061 418/55.6
2018/0347568 A1* 12/2018 Moon ..... F04C 18/0246

FOREIGN PATENT DOCUMENTS

DE 112015004113 T5 7/2017
JP 2002285981 A 10/2002
JP 2005240646 A 9/2005
(Continued)

*Primary Examiner* — Deming Wan
(74) *Attorney, Agent, or Firm* — Shumaker, Loop & Kendrick, LLP; James D. Miller

(57) ABSTRACT

A scroll compressor with oil return unit, having a fixed spiral and an orbiting spiral, which compresses gas from a suction-pressure chamber into a high-pressure chamber. A counter-pressure chamber is connected to the orbiting spiral and the orbiting spiral presses onto the fixed spiral. The oil return unit has a counter-pressure spiral nozzle having a high-pressure channel connected to an end face for oil supply. A suction-pressure spiral nozzle with a suction-pressure channel connected to the end face discharges oil into the suction-pressure chamber. A counter-pressure channel is arranged between the counter-pressure spiral nozzle and the suction-pressure spiral nozzle for discharging oil into the counter-pressure chamber.

10 Claims, 4 Drawing Sheets

(56) References Cited

FOREIGN PATENT DOCUMENTS

Figure 1:
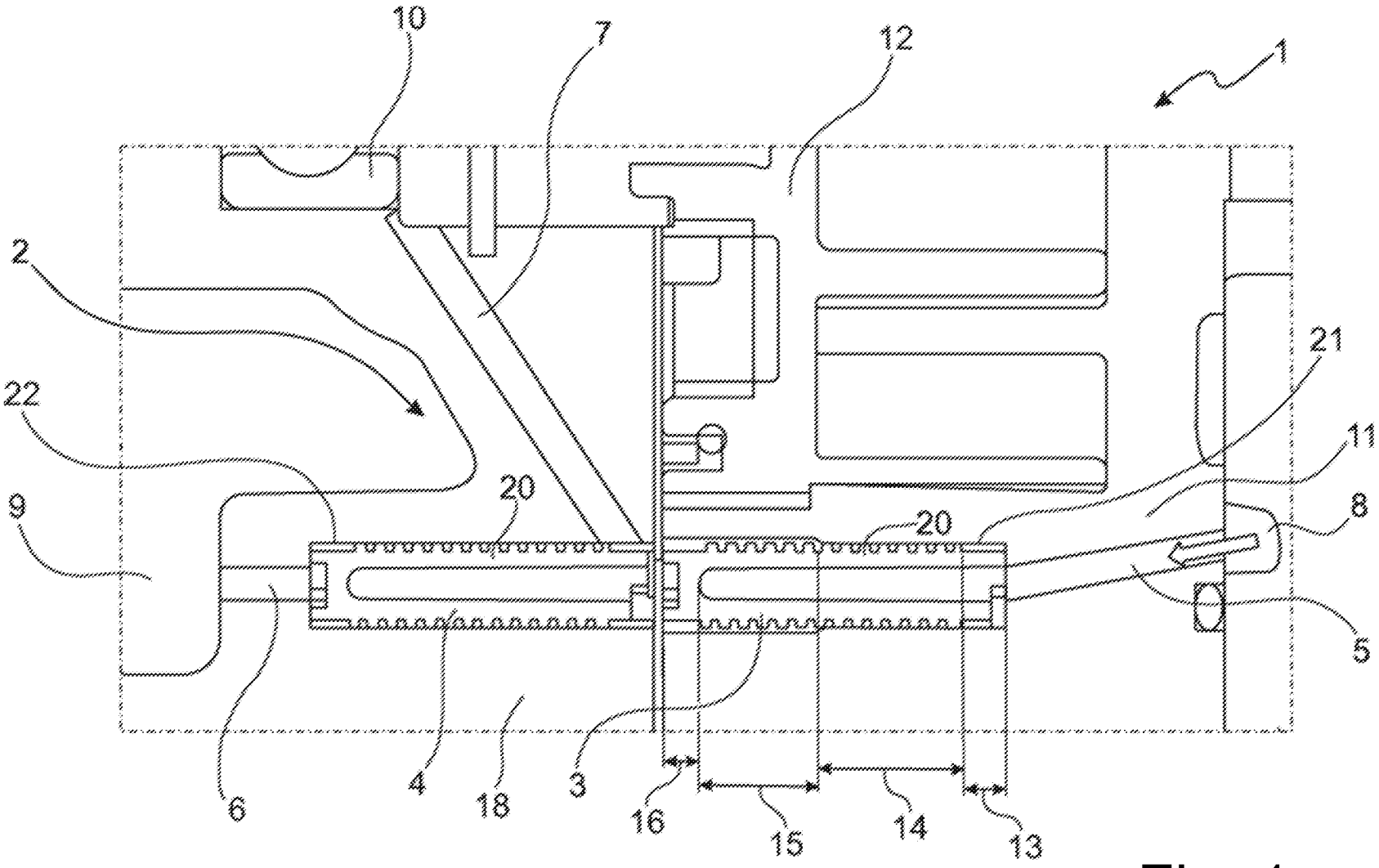

| | | | |
|---|---|---|---|
| JP | 2006348760 | A | 12/2006 |
| JP | 2010190078 | A | 9/2010 |
| JP | 2012207547 | A | 10/2012 |
| JP | 2015036513 | A | 2/2015 |
| JP | 6135126 | B2 | 5/2017 |
| KR | 20160138750 | A | 12/2016 |
| KR | 20170042131 | A | 4/2017 |

* cited by examiner

SPIRAL COMPRESSOR WITH OIL RECIRCULATION UNIT

CROSS-REFERENCE TO RELATED PATENT APPLICATION

This patent claims priority to German Patent Application No. DE 10 2019 101 855.2 filed Jan. 25, 2019 and German Patent Application No. DE 10 2018 121 185.6 filed Aug. 30, 2018, the entire disclosures of which are incorporated herein by reference.

FIELD

The invention relates to a scroll compressor which is particularly provided for use in motor vehicle climate-control systems.

BACKGROUND

Generic scroll compressors are equipped with an oil return unit, which implements the return of the refrigerant oil, which has a certain portion of dissolved refrigerant, from the high-pressure side to the suction-pressure side of the compressor, in order to re-supply the lubricant to lubrication points and thus active points in the compressor on the shortest path possible.

In scroll compressors, which are also characterized as spiral compressors, an orbiting spiral circulates in a vertical spiral, also called a fixed spiral. The movement of the orbiting spiral is associated with the formation of a compression chamber, in which the refrigerant gas is initially suctioned and then compressed over the course of a rotation of the spiral and finally discharged to the high-pressure chamber. For the movement of the orbiting spiral, lubrication of the components is necessary and the oil in this case is conveyed from the intake side of the compressor to the high-pressure side of the compressor. An oil return unit is provided for the return of the oil with a portion of dissolved refrigerant to the intake side.

In order to minimize the friction of the moving components, when there is medium pressure, a counter-pressure chamber is provided, the pressure level of which impacts the orbiting spiral in order to enable an equilibrium of forces with minimal pressure and friction between the components during the movement. This counter-pressure chamber is also provided with refrigerant oil and a certain portion of refrigerant by means of the oil return unit.

In order to minimize losses in efficiency of the coolant circuit due to a short-circuit of the oil circuit from the high-pressure chamber to the suction-pressure chamber, the oil is separated from the refrigerant to the extent possible and brought to the counter-pressure and subsequently to the suction pressure and then re-supplied.

DE 10 2013 226 590 A1 discloses a generic scroll compressor, which has an oil return passage with a flow throttle for the oil return. The flow throttle is provided by a gap between the oil supply opening, which is formed in the fixed spiral, and an insertion component, which is inserted into the oil supply opening. The gap is designed in the form of a spiral groove. It is provided between an inner circumferential surface of the oil supply opening and an outer circumferential surface of an insertion component. The special feature of the scroll compressor is in the design of the spiral groove, which is formed both in the insertion component and in the fixed spiral, wherein the insertion component with the spiral and the through-hole engage in the manner of a threaded hole.

Furthermore, DE 11 2015 004 113 T5 discloses a compressor with an oil return unit, which is formed from two oil transfer elements with spiral grooves for throttling. In doing so, a second oil supply line branching off of the oil return unit is provided, which conveys oil at a counter-pressure level to a counter-pressure chamber.

A disadvantage of the aforementioned two-stage throttling of the refrigerant oil exists in that the elements forming the spiral groove are matched and aligned to the particular application case and are not designed to be adapted to changing conditions.

The disadvantages of the prior art very generally exist in that the oil return cannot be flexibly adapted and the pressure level cannot be simply adapted to different design scenarios.

SUMMARY

The object of the invention is thus to design a scroll compressor with an oil return unit, which can be easily adapted to deviating conditions with respect to the pressure situation.

The object is achieved by means of a subject matter with the features described herein.

The object of the invention is particularly achieved means of a scroll compressor having an oil return unit, which has a fixed spiral and an orbiting spiral, wherein, between the spirals, gas is suctioned from a suction-pressure chamber, compressed, and conveyed to a high-pressure chamber. Furthermore, a counter-pressure chamber is formed, which is connected to the orbiting spiral and which presses the orbiting spiral onto the fixed spiral as counter-pressure for compression, in order to enable movement of the orbiting spiral in the fixed spiral with minimal friction by means of equilibrium of forces.

The oil return unit substantially consists of two main components. One is a counter-pressure spiral nozzle, which is connected, at an end face, to a high-pressure channel. The high-pressure channel conveys the oil from the high-pressure chamber of the scroll compressor to the counter-pressure spiral nozzle. Furthermore, the oil return unit consists of a suction-pressure spiral nozzle, which, in turn, is connected at an end face to the suction-pressure channel to discharge oil into the suction-pressure chamber. A counter-pressure channel, which discharges oil into the counter-pressure chamber, branches off between the counter-pressure spiral nozzle and the suction-pressure spiral nozzle at a pressure level, which is characterized as the counter-pressure level.

In a particular manner, the invention is characterized in that the counter-pressure spiral nozzle consists of a cylindrical cavity, particularly a cylindrical borehole in the fixed spiral, and a spiral nozzle insert inserted into said cylindrical cavity.

The suction-pressure spiral nozzle is formed from a cylindrical cavity in the middle housing, which is preferably designed as a cylindrical borehole. In turn, a spiral nozzle insert is arranged in the cylindrical cavity. The spiral nozzle insert interacts with the wall of the cylindrical cavity such that the spiral nozzle is formed between the surface of the spiral nozzle insert and the wall of the cylindrical cavity. The surface of the spiral nozzle insert preferably has a spiral-shaped groove, which forms a spiral-shaped throttle channel in the area of contact of the spiral nozzle insert with the wall of the cylindrical cavity. The cylindrical cavity of the fixed spiral then has an expansion region, in which the spiral nozzle insert is not in contact with the wall of the cylindrical cavity such that the throttling in the area of the expansion region does not take place or is greatly reduced.

Advantageously, the cylindrical cavity has an expansion region in the middle housing, in which the spiral nozzle insert is likewise not in contact with the cylindrical cavity in the medium-pressure housing and the throttling is thus at least reduced.

The expansion region and particularly the adaptation of the expansion region thus represents a possibility of adapting the throttling by changing the effective length of the spiral. A longer expansion region shortens the spiral and thus the throttling and vice versa.

Preferably, the cylindrical cavity has a larger diameter relative to the spiral nozzle insert in the expansion region, such that the spiral groove of the spiral nozzle insert has no effect in this area and no throttling takes place in the expansion region.

Alternatively, the cylindrical cavity, as a borehole, has a uniform diameter over the entire length, wherein the spiral nozzle insert has a reduced diameter in the expansion region such that, as a result, there is again no throttling in the expansion region.

The design of the high-pressure channel for connecting the high-pressure chamber to the counter-pressure spiral nozzle of the oil return unit is tilted, according to one embodiment, at an angle $\alpha$ sloping from the high-pressure chamber to the counter-pressure spiral nozzle or may also be straight as an alternative. The angle or the design of the high-pressure channel depends on the location and position of the high-pressure chamber and the spiral nozzle with respect to one another.

The high-pressure channel may also be formed with a step according to an alternative embodiment. The high-pressure channel, which is designed as a two-part, offset supply borehole, consists of a central borehole, which is designed coaxially with respect to the cylindrical cavity and a stepped borehole offset axially thereto. The stepped borehole and the central borehole are arranged one below the other from the high-pressure chamber to the counter-pressure spiral nozzle and designed notched with respect to the cylindrical cavity. It is decisive for the function that there be a fluid connection and thus a transition from the high-pressure channel to the cylindrical cavity.

It is further advantageous, in addition to the pressure difference, to also use the position and particularly the height difference, in a supporting manner, as a driving force to convey the refrigerant oil from the high-pressure chamber to the spiral nozzle. Thus, a suitable design of the high-pressure channel or an arrangement of stepped, straight channel pieces with a notch-like connection to one another is advantageous.

The spiral nozzle insert is a tubular body, which is open on one end and closed on the other end. The spiral nozzle insert has a spiral groove externally, which forms a spiral-shaped channel, together with the wall of the cylindrical cavity, for throttling the refrigerant oil. The open end of the spiral nozzle insert faces the high-pressure channel such that refrigerant oil flowing in the high-pressure channel flows into the inner cavity of the spiral nozzle insert. The highly pressurized refrigerant oil expands the spiral nozzle insert slightly, whereby it makes contact with the wall of the cylindrical cavity in a sealing manner. The spiral groove hereby forms between the cylindrical cavity and the outer surface of the spiral nozzle insert. If the cavity of the spiral nozzle insert is filled with refrigerant oil, it flows through the overflow openings in the spiral nozzle insert on the open end of the spiral nozzle insert to the outer side and subsequently through the spiral groove to the collection area. The throttling of the refrigerant oil takes place in the counter-pressure throttle region and in the suction-pressure throttle region while oil is flowing through the spiral groove. Depending on the design, the spiral nozzle insert is preferably formed from plastic or metal.

The expansion region of the cylindrical cavity in the fixed spiral may be implemented by the cylindrical cavity as a tiered borehole and extend over the entire circumference of the cylindrical cavity. The cylindrical cavity for mounting the spiral nozzle insert is advantageously implemented as a borehole and is thus preferably in the shape of a circular cylinder.

Furthermore, the high-pressure channel can be drilled from the cylindrical cavity straight or angled as a supply borehole.

Advantageously, a wear plate with a flow borehole, which separates the two spiral nozzles and the fixed spiral from the middle housing, is arranged between the counter-pressure spiral nozzle and the suction-pressure spiral nozzle.

The counter-pressure spiral nozzle is divided into different subregions. Advantageously, an inlet region is arranged upstream of the counter-pressure throttle region of the counter-pressure spiral nozzle.

It is likewise advantageous to provide an inlet region with a branch to the counter-pressure channel upstream of the suction-pressure throttle region of the suction-pressure spiral nozzle.

Preferably, a collection area for the refrigerant oil is arranged downstream of the counter-pressure throttle region and downstream of the suction-pressure throttle region.

In the counter-pressure throttle region and in the suction-pressure throttle region, the spiral nozzle insert makes contact with the wall of the cylindrical cavity, and/or the borehole. Thus, the spiral groove, in which the throttling of the fluid, which is refrigerant oil in this case, is formed in the throttle regions.

In other words, the concept of the invention exists in that a spiral-shaped nozzle, with laminar flow for the refrigerant oil, is used as a laminar spiral nozzle on the wall of a borehole, as a resistance regulator for throttling. In this process, the spiral profile of the spiral nozzle insert and the wall of the borehole represent the flow channel. Only the region with the wall placed correctly for contact is used for throttling the oil. The adaptation of the effective area is to be achieved simply, economically, and advantageously by means of changing the drill geometry while simultaneously retaining the other parts and parameters.

According to the concept, the area used for the throttle effect can be adapted by changing the diameter of the borehole and/or of the spiral nozzle insert and the length of the active section in an expansion region, and a different pressure level can be set. If the borehole diameter is enlarged, the throttling in the enlarged region can be suppressed without having to modify the laminar spiral nozzle itself. The entire system of the laminar spiral nozzle resistor cascade and its interactions must be observed at all times.

It should be considered particularly advantageous that an optimal setting of the counter-pressure level can take place at all operating points with optimized oil management.

It is economically advantageous that the use of standardized and equivalent parts, such as the spiral nozzle insert, is possible in various applications, and only the shape and the length of the expansion region can be optimized in the form of a counterbore.

The production of the differences for the individual operating points takes place by means of different machining for the borehole diameter and the shape of the transitions.

Important embodiments of the invention exist in the enlarged diameter of the counterbores, and therefore of the expanded region in the fixed spiral as well as the inclined flow path from the high-pressure chamber to the counter-pressure spiral nozzle.

With a throttle cascade of the counter-pressure spiral nozzle, the medium-pressure level, also characterized as the counter-pressure level, is adjusted by means of the changes in the length of the counterbore for the expansion region. When a laminar spiral nozzle is used as a throttle in a borehole, the throttle channel is formed by the spiral nozzle profile and the wall of the borehole with the corresponding sealing diameter. The setting of the medium-pressure level takes place by means of a change in the length of the borehole wall with the corresponding sealing diameter by means of a borehole with a larger diameter, the counterbore.

With this design, a uniform spiral nozzle insert can be used to set the medium pressure in a broad range. The counterbore, that is the expansion region, can be used at both ends of the respective spiral nozzles and on all spiral nozzles, which are parts of a throttle cascade. By reducing the sealing bore length through the expansion region, the length of the laminar flow channel is reduced and thus the restriction and the throttle effect are reduced. The intermediate pressure is increased, for example, by changing, for example reducing the restriction of the first flow restrictor and not changing the other flow restrictors in the cascade.

DRAWINGS

Figure 2:
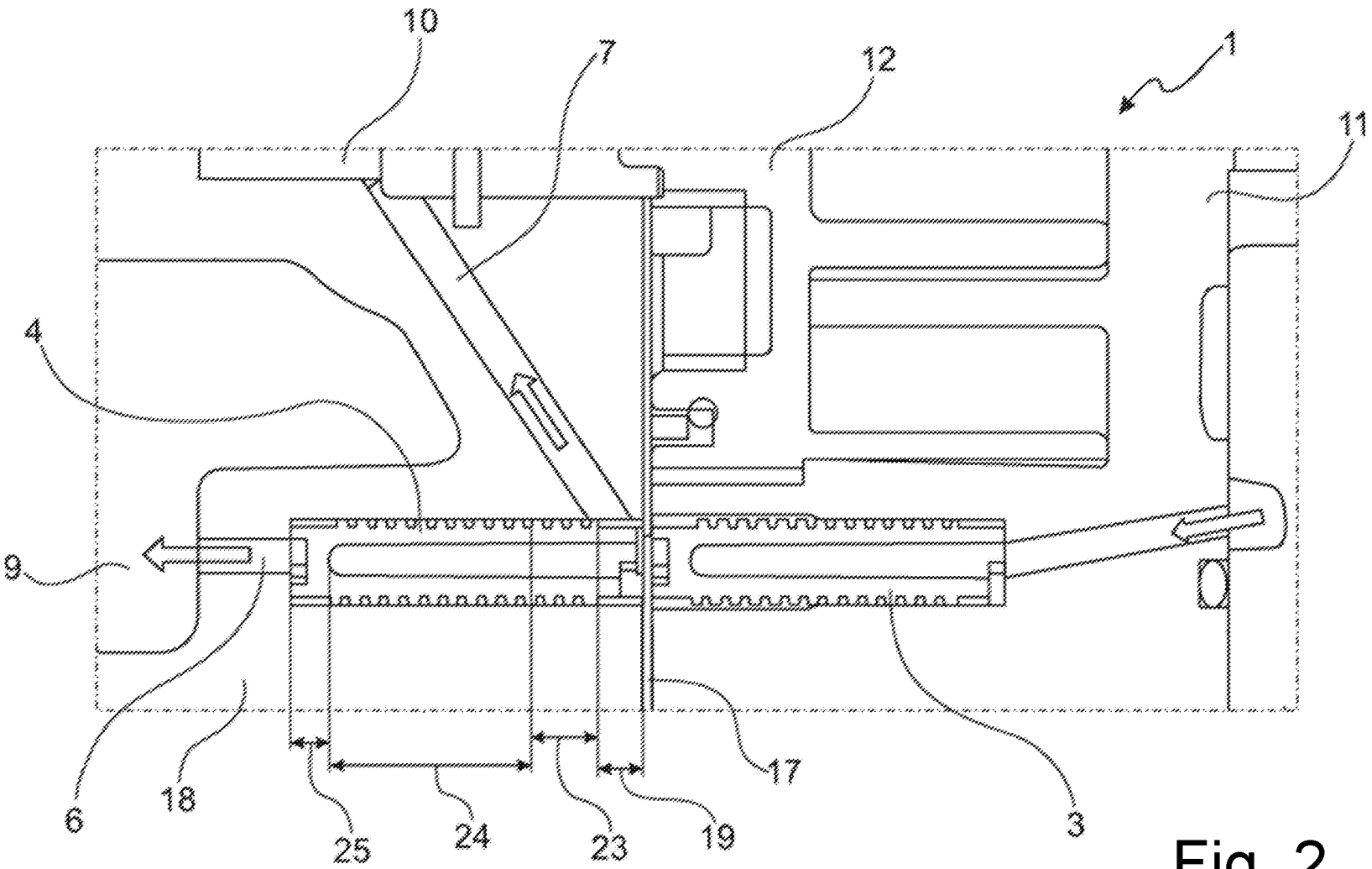
Figure 3:
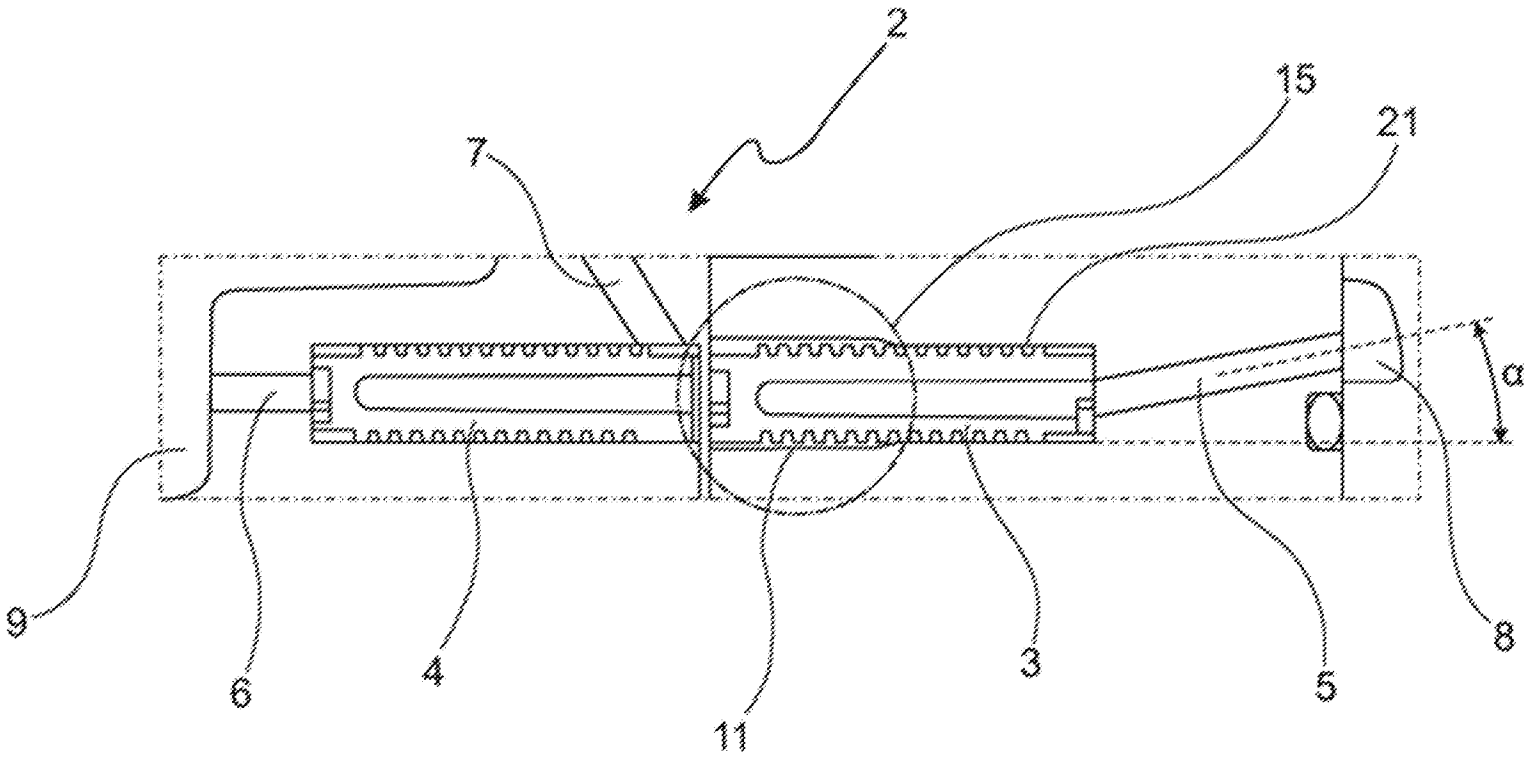

Further details, features, and advantages of embodiments of the invention result from the following description of exemplary embodiments with reference to the corresponding drawings. The following is shown:

FIG. 1: Detailed view of a scroll compressor with an oil return unit having a counter-pressure spiral nozzle;

FIG. 2: The scroll compressor according to FIG. 1 with suction-pressure spiral nozzle;

FIG. 3: Detailed view of the oil return unit with inclined high-pressure channel; and FIGS. 4, 5: Detailed views of the oil return unit with offset supply borehole as a high-pressure channel.

DETAILED DESCRIPTION

The cutout of the scroll compressor 1 with an oil return unit 2 is shown in detail in FIG. 1.

The scroll compressor 1 has a fixed spiral 11 and an orbiting spiral 12 moving in said fixed spiral. Between the spirals, there are resulting chambers that change during the movement, which have a low or a high pressure depending on the position of the spirals 11, 12 with respect to one another. The refrigerant gas-oil mixture reaches the high-pressure chamber 8 under high pressure, wherein the oil is separated out after the compression process in the high-pressure chamber 8 and supplied from there to the suction-pressure chamber 9 by means of the oil return unit 2.

The refrigerant gas is suctioned with the oil from the suction-pressure chamber 9, then compressed between the spirals 11, 12, and conveyed to the high-pressure chamber 8; the circuit is closed.

The oil return unit 2 is used to convey the oil separated after the compression process from the high-pressure chamber 8 back into the suction-pressure chamber 9 and, in doing so, additionally to provide a partial quantity of the oil at a medium pressure, which is also characterized as a counter-pressure in a counter-pressure chamber 10. The counter-pressure is necessary in order to press the orbiting spiral 12 against the fixed spiral 11 and to establish equilibrium of forces between the forces in the high-pressure chamber 8 on one side of the orbiting spiral 12 and the forces in the counter-pressure chamber 10 on the other side of the orbiting spiral 12.

The oil return unit 2 consists of a counter-pressure spiral nozzle 3 and a suction-pressure spiral nozzle 4. The counter-pressure spiral nozzle 3 is formed by means of a spiral nozzle insert 20 in a cylindrical cavity 21 within the fixed spiral 11. The throttle effect of the counter-pressure spiral nozzle 3 is finally achieved by means of the spiral nozzle insert 20, with which a corresponding spiral or ring groove forms a ring groove of defined size and length along the inner surface of the cylindrical cavity 21 and within which the refrigerant oil flows from the high-pressure chamber 8, via the high-pressure channel 5, into the area of the counter-pressure spiral nozzle 3 and is throttled in doing so.

At the start of the counter-pressure spiral nozzle 3, an inlet region 13 is provided, which enables uniform distribution of the refrigerant oil along the wall of the cylindrical cavity 21, before the oil enters the ring groove or spiral groove. The area of the actual throttling of the counter-pressure spiral nozzle 3 is characterized as the counter-pressure throttle region 14. After passing through the counter-pressure throttle region 14, the oil is brought to the counter-pressure level and reaches the collection area 16, by means of the expansion region 15 of the counter-pressure spiral nozzle 3 in the fixed spiral 11, where the oil is collected and transferred into the next area of the oil return unit 2. The throttle effect on the oil takes place almost exclusively in the counter-pressure throttle region 14, while the subsequent expansion region 15 and the collection area 16 have essentially no throttle effect on the oil. In the middle housing 18, a cylindrical cavity 22 is arranged with the suction-pressure spiral nozzle 4, which is connected to the suction-pressure chamber 9 by means of the suction-pressure channel 6. Furthermore, the counter-pressure chamber 10 is connected to the cylindrical cavity 22 by means of the counter-pressure channel 7.

In contrast to FIG. 1, the suction-pressure spiral nozzle 4 is broken down into greater detail in FIG. 2. The refrigerant oil brought to the counter-pressure level goes through the wear plate 17 into the suction-pressure spiral nozzle 4 with the flow borehole. The refrigerant oil is routed to the counter-pressure channel 7 in the inlet region 19 with a branch for the refrigerant oil. The counter-pressure channel 7 is connected to the counter-pressure chamber 10, which, in turn, has an active connection to the back side of the orbiting spiral 12 in order to generate the corresponding counter-pressure upon the movement of the orbiting spiral 12. The refrigerant oil, which is not routed into the counter-pressure chamber 10 by means of the counter-pressure channel 7, is then further expanded in the suction-pressure spiral nozzle 4 and correspondingly in the suction-pressure throttle region 24 and reaches the collection area 25 of the suction-pressure spiral nozzle 4, where the refrigerant oil is transferred to the suction-pressure channel 6 at suction pressure. The refrigerant oil finally reaches the suction-pressure chamber 9 in the suction-pressure channel 6. In the suction-pressure chamber 9, the refrigerant oil with the refrigerant gas at suction-pressure level is suctioned from the suction-gas inlet and the fixed spiral and finally compressed between the spirals 11, 12, whereby the oil circuit shown here is closed.

An indicated pressure adaptation of the suction pressure can take place by means of an expansion region 23 in the middle housing 18.

FIG. 3 shows the oil return unit 2 in enlarged detail, wherein particularly the position of the high-pressure channel 5 is shown with emphasis. The high-pressure channel 5, which is positioned between the counter-pressure spiral nozzle 3 and the high-pressure chamber 8, is inclined from the high-pressure chamber 8 toward the counter-pressure spiral nozzle 3 at an angle α. The incline and thus the angle α is 3° to 6° in order to ensure an optimized flow of the refrigerant oil into the oil return unit 2. Particularly emphasized in the drawing is the expansion region 15 in the fixed spiral 11, wherein the expansion region 15 is designed as a type of counterbore in the cylindrical cavity 21.

Figure 4:
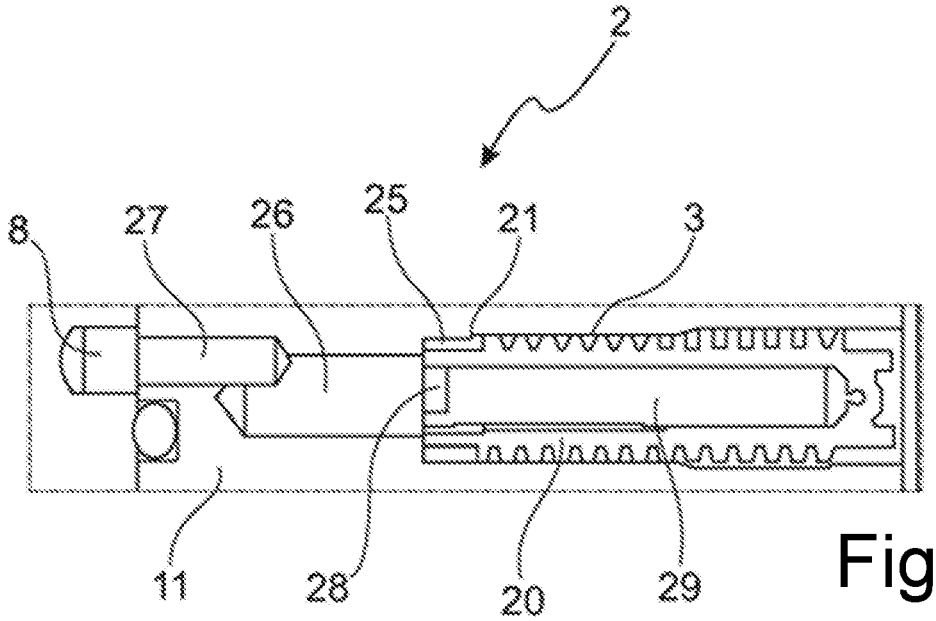
Figure 5:
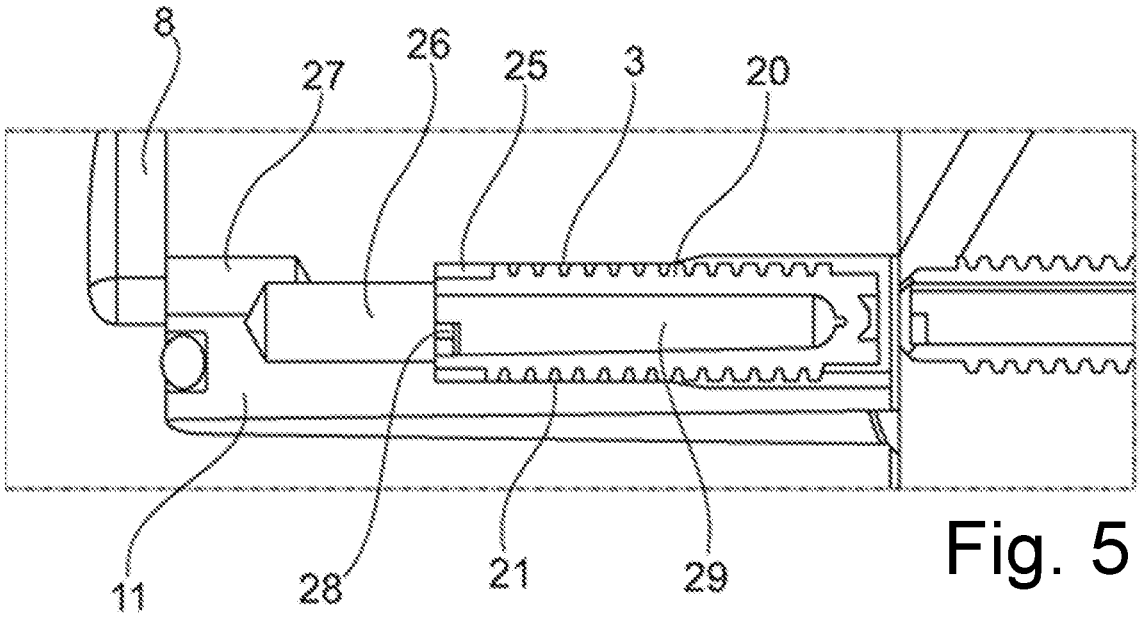

FIGS. 4 and 5 show views with details of the oil return unit 2 in the fixed spiral 11 with an offset supply borehole as the high-pressure channel. The supply borehole consists of a central borehole 26 and a stepped borehole 27. The central borehole 26 is designed coaxially with respect to the cylindrical cavity 21 and has a reduced diameter compared thereto. The stepped borehole 27 is offset in parallel upward in its axial position and overlaps with the central borehole 26 in the area of the notch. This area forms the connection between the stepped borehole 27 and the central borehole 26. The diameter of the central borehole 26 correlates to the cavity 29 of the spiral nozzle insert 20 of the counter-pressure spiral nozzle 3. The stepped drill hole 27 connects the high-pressure chamber 8 to the central borehole 26. The refrigerant oil thus flows from the high-pressure chamber 8, via the stepped borehole 27 and the notch area, into the central borehole 26 and into the cavity 29 of the spiral nozzle insert 20. Once the cavity 20 is filled, the refrigerant oil flows from the cavity 29, through the overflow openings 28 in the wall of the spiral nozzle insert 20, into the collection area 25, which is formed between the outer side of the spiral nozzle insert 20 and the outer wall of the cylindrical cavity 21, before it enters the spiral groove. The arrangement, which is offset in height from above to below, of the high-pressure chamber 8, the stepped borehole 27, and the central borehole 26 leads to support of the oil flow from the high-pressure chamber 8 into the counter-pressure spiral nozzle 3 by means of the height difference.

LIST OF REFERENCE NUMERALS

1 Scroll compressor
2 Oil return unit
3 Counter-pressure spiral nozzle
4 Suction-pressure spiral nozzle
5 High-pressure channel
6 Suction-pressure channel
7 Counter-pressure channel
8 High-pressure chamber
9 Suction-pressure chamber
10 Counter-pressure chamber
11 Fixed spiral
12 Orbiting spiral
13 Inlet region, counter-pressure spiral nozzle
14 Counter-pressure throttle region
15 Expansion region, fixed spiral
16 Collection area
17 Wear plate with flow borehole
18 Middle housing
19 Inlet region with branch
20 Spiral nozzle insert
21 Cylindrical cavity in fixed spiral
22 Cylindrical cavity in middle housing
23 Expansion region, middle housing
24 Suction-pressure throttle region
25 Collection area
26 Central borehole
27 Stepped borehole
28 Overflow opening
29 Cavity

What is claimed is:

1. A scroll compressor with oil return unit, the scroll compressor comprising:

a fixed spiral and an orbiting spiral which compress gas from a suction-pressure chamber into a high-pressure chamber;

a counter-pressure chamber is connected to the orbiting spiral and the orbiting spiral presses onto the fixed spiral, wherein the oil return unit has a counter-pressure spiral nozzle having a high-pressure channel connected to an end face thereto for oil supply and a suction-pressure spiral nozzle with a suction-pressure channel connected to the end face thereto for discharging oil into the suction-pressure chamber, wherein a counter-pressure channel is arranged between the counter-pressure spiral nozzle and the suction-pressure spiral nozzle for discharging oil into the counter-pressure chamber, wherein the counter-pressure spiral nozzle is formed from a cylindrical cavity in the fixed spiral and a spiral nozzle insert and the suction-pressure spiral nozzle is formed from a cylindrical cavity in a middle housing and the spiral nozzle insert, and wherein the cylindrical cavity in the fixed spiral has an expansion region in the fixed spiral, in which the spiral nozzle insert does not make contact with the cylindrical cavity in the fixed spiral wherein the expansion region is arranged downstream of a counter-pressure throttle region of the counter-pressure spiral nozzle, and wherein oil is released by throttling while passing through the counter-pressure throttle region, and then delivered to the suction-pressure spiral nozzle through the expansion region where throttling is not performed.

2. The scroll compressor according to claim 1, wherein the cylindrical cavity in the middle housing has an expansion region, in which the spiral nozzle insert does not make contact with the cylindrical cavity in the middle housing.

3. The scroll compressor according to claim 2, wherein the cylindrical cavities have a larger diameter in the expansion region such that no throttling occurs in the expansion region.

4. The scroll compressor according to claim 2, wherein the cylindrical cavities have a uniform diameter over an entire length and the spiral nozzle insert has a reduced diameter in the expansion region such that no throttling occurs in the expansion region.

5. The scroll compressor according to claim 1, wherein the high-pressure channel is tilted at an angle α sloping from the high-pressure chamber to the counter-pressure spiral nozzle.

6. The scroll compressor according to claim 1, wherein the high-pressure channel is formed as a supply borehole, wherein the supply borehole is formed from a central borehole coaxially with respect to the cylindrical cavity in the fixed spiral and a stepped borehole offset axially thereto and the stepped borehole and the central borehole are arranged one below the other from the high-pressure chamber to the counter-pressure spiral nozzle and include a notch.

7. The scroll compressor according to claim 1, wherein a wear plate with a flow borehole is arranged between the counter-pressure spiral nozzle and the suction-pressure spiral nozzle.

8. The scroll compressor according to claim 1, wherein a first inlet region is arranged upstream of a counter-pressure throttle region of the counter-pressure spiral nozzle.

9. The scroll compressor according to claim 8, wherein a second inlet region with a branch to the counter-pressure channel is arranged upstream of a suction-pressure throttle region of the suction-pressure spiral nozzle.

10. The scroll compressor according to claim 9, wherein a collection area is arranged downstream of the counter-pressure throttle region and downstream of the suction-pressure throttle region.

* * * * *